US010458647B2

(12) United States Patent
Wiklof et al.

(10) Patent No.: US 10,458,647 B2
(45) Date of Patent: Oct. 29, 2019

(54) ADAPTOR FOR PROVIDING ELECTRICAL COMBUSTION CONTROL TO A BURNER

(71) Applicant: ClearSign Combustion Corporation, Seattle, WA (US)

(72) Inventors: Christopher A. Wiklof, Everett, WA (US); Nicholas S. Bromer, Marietta, PA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 846 days.

(21) Appl. No.: 14/827,390

(22) Filed: Aug. 17, 2015

(65) Prior Publication Data

US 2016/0047542 A1 Feb. 18, 2016

Related U.S. Application Data

(60) Provisional application No. 62/037,962, filed on Aug. 15, 2014.

(51) Int. Cl.
*F23C 99/00* (2006.01)
*F23C 5/02* (2006.01)

(52) U.S. Cl.
CPC ..... *F23C 99/001* (2013.01); *F23C 5/02* (2013.01)

(58) Field of Classification Search
CPC ..... F23C 5/02; F23C 99/001
See application file for complete search history.

(56) References Cited

U.S. PATENT DOCUMENTS 1,568,620 A * 1/1926 Potteiger ..... F23Q 3/00 236/25 R
2,374,610 A * 4/1945 McLaren, Jr. ..... F23N 5/123 307/653
2,604,936 A 7/1952 Kaehni et al.
2,635,813 A * 4/1953 Schlenz ..... F23D 17/00 236/1 A
3,306,338 A 2/1967 Wright et al.
3,384,439 A * 5/1968 Walbridge ..... F23N 5/123 315/209 R
3,975,137 A * 8/1976 Hapgood ..... F23N 1/082 431/66
4,111,636 A 9/1978 Goldberg
4,737,102 A * 4/1988 Jinno ..... F23C 5/02 122/18.4
5,000,159 A * 3/1991 Clarke ..... F23D 14/22 126/91 A (Continued)

FOREIGN PATENT DOCUMENTS

DE 4238718 A1 * 5/1994 ..... F23C 5/02
EP 0844434 5/1998

(Continued)

*Primary Examiner* — Kenneth Rinehart
*Assistant Examiner* — Logan P Jones
(74) *Attorney, Agent, or Firm* — Christopher A. Wiklof; David C. Conlee; Launchpad IP, Inc.

(57) ABSTRACT

Technologies are provided for an adaptor for introducing electricity into a combustion chamber, for the purpose of electrical flame or combustion control. The adaptor may be placed between a conventional burner assembly and a conventional combustion chamber wall. The adaptor includes an aperture for admitting electricity into the combustion chamber.

15 Claims, 6 Drawing Sheets

(56) References Cited

U.S. PATENT DOCUMENTS 5,003,960 A * 4/1991 Hanagan ..... A47J 37/0704 126/39 BA
5,358,400 A * 10/1994 Ejiri ..... F23C 15/00 123/169 EC
5,393,224 A * 2/1995 Allen ..... F23Q 3/008 431/263
5,784,889 A 7/1998 Joos et al.
6,470,684 B2 * 10/2002 Wilbraham ..... F23C 99/001 239/690
7,137,808 B2 11/2006 Branston et al.
7,243,496 B2 7/2007 Pavlik et al.
8,851,882 B2 10/2014 Hartwick et al.
8,881,535 B2 11/2014 Hartwick et al.
8,911,699 B2 12/2014 Colannino et al.
9,151,252 B2 * 10/2015 Hernandez ..... F02B 23/101
9,151,549 B2 10/2015 Goodson et al.
9,209,654 B2 12/2015 Colannino et al.
2001/0045474 A1 * 11/2001 Wilbraham ..... F23C 99/001 239/690
2005/0208442 A1 9/2005 Heiligers et al.
2010/0065663 A1 * 3/2010 Wilbraham ..... F23C 99/001 239/518
2011/0203771 A1 8/2011 Goodson et al.
2013/0004902 A1 1/2013 Goodson et al.
2013/0071794 A1 3/2013 Colannino et al.
2013/0230810 A1 9/2013 Goodson et al.
2013/0230811 A1 9/2013 Goodson et al.
2013/0255482 A1 10/2013 Goodson
2013/0255548 A1 10/2013 Goodson et al.
2013/0255549 A1 10/2013 Sonnichsen et al.
2013/0260321 A1 10/2013 Colannino et al.
2013/0323655 A1 12/2013 Krichtafovitch et al.
2013/0323661 A1 12/2013 Goodson et al.
2013/0333279 A1 12/2013 Osler et al.
2013/0336352 A1 12/2013 Colannino et al.
2014/0038113 A1 2/2014 Breidenthal et al.
2014/0051030 A1 2/2014 Colannino et al.
2014/0065558 A1 3/2014 Colannino et al.
2014/0076212 A1 3/2014 Goodson et al.
2014/0080070 A1 3/2014 Krichtafovitch et al.
2014/0162195 A1 6/2014 Lee et al.
2014/0162196 A1 6/2014 Krichtafovitch et al.
2014/0162197 A1 6/2014 Krichtafovitch et al.
2014/0162198 A1 6/2014 Krichtafovitch et al.
2014/0170569 A1 6/2014 Anderson et al.
2014/0170571 A1 6/2014 Casasanta, III et al.
2014/0170575 A1 6/2014 Krichtafovitch
2014/0170576 A1 6/2014 Colannino et al.
2014/0170577 A1 6/2014 Colannino et al.
2014/0186778 A1 7/2014 Colannino et al.
2014/0196368 A1 7/2014 Wiklof
2014/0196369 A1 7/2014 Wiklof
2014/0208758 A1 7/2014 Breidenthal et al.
2014/0212820 A1 7/2014 Colannino et al.
2014/0216401 A1 8/2014 Colannino et al.
2014/0227645 A1 8/2014 Krichtafovitch et al.
2014/0227646 A1 8/2014 Krichtafovitch et al.
2014/0227649 A1 8/2014 Krichtafovitch et al.
2014/0234786 A1 8/2014 Ruiz et al.
2014/0234789 A1 8/2014 Ruiz et al.
2014/0248566 A1 9/2014 Krichtafovitch et al.
2014/0251191 A1 9/2014 Goodson et al.
2014/0255855 A1 9/2014 Krichtafovitch
2014/0255856 A1 9/2014 Colannino et al.
2014/0272731 A1 9/2014 Breidenthal et al.
2014/0287368 A1 9/2014 Krichtafovitch et al.
2014/0295094 A1 10/2014 Casasanta, III
2014/0295360 A1 10/2014 Wiklof
2014/0335460 A1 11/2014 Wiklof et al.
2014/0338350 A1 11/2014 Breidenthal et al.
2015/0079524 A1 3/2015 Colannino et al.
2015/0104748 A1 4/2015 Dumas et al.
2015/0107260 A1 4/2015 Colannino et al.
2015/0118629 A1 4/2015 Colannino et al.
2015/0121890 A1 5/2015 Colannino et al.
2015/0140498 A1 5/2015 Colannino
2015/0147704 A1 5/2015 Krichtafovitch et al.
2015/0147705 A1 5/2015 Colannino et al.
2015/0147706 A1 5/2015 Krichtafovitch et al.
2015/0219333 A1 8/2015 Colannino et al.
2015/0226424 A1 8/2015 Breidenthal et al.
2015/0241057 A1 8/2015 Krichtafovitch et al.
2015/0276211 A1 10/2015 Colannino et al.
2015/0338089 A1 11/2015 Krichtafovitch et al.
2015/0345780 A1 12/2015 Krichtafovitch
2015/0345781 A1 12/2015 Krichtafovitch et al.
2015/0362177 A1 12/2015 Krichtafovitch et al.
2015/0362178 A1 12/2015 Karkow et al.
2015/0362718 A1 12/2015 Karkow et al.
2015/0369476 A1 12/2015 Wiklof
2016/0018103 A1 1/2016 Karkow et al.
2016/0091200 A1 3/2016 Colannino et al.
2016/0161115 A1 6/2016 Krichtafovitch et al.
2016/0290639 A1 10/2016 Karkow et al.

FOREIGN PATENT DOCUMENTS

EP 3059496 A1 * 8/2016 ..... F23N 5/123
FR 2564334 A2 * 11/1985 ..... B01J 12/002
FR 2648896 A1 * 12/1990 ..... F23C 5/02
GB 2487134 B * 12/2012 ..... F23Q 3/006
JP H 07-48136 2/1995
WO WO 2014/160830 10/2014
WO WO 2014/197108 12/2014
WO WO 2015/012872 1/2015
WO WO 2015/017084 2/2015
WO WO 2015/017087 2/2015
WO WO 2015/038245 3/2015
WO WO 2015/042566 3/2015
WO WO 2015/051136 4/2015
WO WO 2015/051377 4/2015
WO WO 2015/057740 4/2015
WO WO 2015/089306 6/2015
WO WO 2015/103436 7/2015
WO WO 2015/123683 8/2015
WO WO 2016/003883 1/2016
WO WO 2016/018610 2/2016

* cited by examiner

ADAPTOR FOR PROVIDING ELECTRICAL COMBUSTION CONTROL TO A BURNER

CROSS REFERENCE TO RELATED APPLICATIONS

The present application claims priority benefit from U.S. Provisional Patent Application No. 62/037,962, entitled "ELECTRICAL PASSTHROUGH ADAPTOR FOR COMBUSTION CONTROL", filed Aug. 15, 2014; which, to the extent not inconsistent with the disclosure herein, is incorporated by reference.

BACKGROUND

About two-thirds of global energy consumption occurs as hydrocarbon fuel combustion in boilers, furnaces, kilns, and turbines. A small percentage of consumption is provided by combustion of other fuels such as hydrogen and carbon monoxide. The energy released by the combustion is used to generate electrical power and to provide heat for a wide range of industrial and commercial purposes.

In conventional furnaces, boilers, process heaters, and the like, combustion air and fuel are supplied to a "burner assembly". The part that outputs fuel to the combustion chamber is called a fuel nozzle (in the case of a non-premixing nozzle). Air can be forced air or natural draft. In many burner assemblies, the air and fuel are admitted in close proximity to one another. Another part of some conventional burner assemblies is a flame holder. Compared to usually-seen flames, the fuel and air velocities in an industrial burner assembly may tend to be too high to hold the flame against the fuel nozzle (or for the flame to be held in an equilibrium position where the flame speed is equal to the fuel and air velocity). A burner assembly manufacturer may therefore add an eddy-producing flame-holder structure to cause the flame to be held in a known position. In some burner assemblies, the flame holder is a refractory material that extends into the combustion chamber; such a refractory flame holder is often referred to as a burner tile.

This conventional structure works adequately but could be improved by reducing emissions and by improving the combustion process. It has been found by the inventors that electricity can be applied to the combustion reaction, and the characteristics of the combustion reaction can be selected according to electrode geometry and location, as well as electric signal characteristics (e.g., AC vs. DC, frequency, waveform sharpness, phase relationships, and voltage), to improve combustion. However, conventional devices may suffer from limited provisions for passing electrical signals, especially high-voltage signals, to the combustion chamber.

SUMMARY

According to embodiments, methods and apparatuses for introducing electricity to a combustion chamber heated by a burner assembly are provided. The burner can be used to drive a gas and/or steam turbine, produce hot water or steam, or drive an endothermic reaction in an industrial process, for example. More particularly, embodiments include an adaptor accessory mounted between the burner assembly and a wall of a combustion chamber. The adaptor includes a provision for passing an electrical conductor for transferring electricity from an electrical source outside of the combustion chamber to one or more electrodes inside the combustion chamber.

Conventional mounting of a burner assembly to the wall of the combustion chamber (e.g., the floor of an up-fired furnace or a front wall of a package boiler) may involve bolts or other fasteners that fasten the burner assembly to the combustion chamber wall. According to an embodiment, the inventors contemplate replacing conventional fasteners with hollow fasteners that include an insulated passage for a high voltage electrical conductor. According to another embodiment, the inventors contemplate an adaptor including a spacer configured to fit between the burner assembly and the combustion chamber wall. One or more electrical conductors convey electricity through a wall of the spacer. Optionally the spacer can include one or more additional electrical conductors for passing sensor signals and the like through the wall of the spacer.

According to an embodiment, a combustion system includes a combustion chamber wall defining a combustion chamber and a burner assembly configured to operatively couple to an exterior of the combustion chamber wall and to support a combustion reaction inside the combustion chamber. An adaptor is configured to couple between the burner assembly and the combustion chamber wall. The adaptor includes an adaptor body defining an aperture configured to pass an electrical conductor therethrough. The electrical conductor is configured to carry a high voltage electrical signal from outside the combustion chamber wall to inside the combustion chamber through the adaptor body aperture. In an embodiment, the aperture is configured to receive an electrical bushing and the electrical bushing is configured to carry the electrical conductor.

According to an embodiment, an adaptor for a combustion system includes an adaptor body defining a) an aperture configured to pass an electrical conductor therethrough, b) a proximal flange coupled to or integral with the adaptor body, the proximal flange defining a pattern of bolt holes selected to couple to a mounting flange of a burner assembly, and c) a distal flange coupled to or integral with the adaptor body, the distal flange defining a pattern of bolt holes selected to couple to a mounting surface of a combustion chamber wall. The adaptor can be structured to pass a wire carrying a high voltage electrical signal through the aperture without electrical short or open circuit. The high voltage electrical signal can be provided by a power supply external to the combustion chamber, and the high voltage signal can be used inside the combustion chamber to modify or control an aspect of a combustion reaction supported by the burner.

According to an embodiment, a method includes providing a combustion chamber wall defining a combustion chamber providing a burner assembly configured to operatively couple to an exterior of the combustion chamber wall and configured to support a combustion reaction inside the combustion chamber, providing an adaptor configured to couple between the burner assembly and the combustion chamber wall, wherein the adaptor further comprises an adaptor body defining an aperture configured to pass an electrical conductor therethrough and coupling the the burner assembly to the combustion chamber wall via the adaptor. The method can further include passing the electrical conductor through the aperture and/or providing an electrical bushing between the adaptor and the electrical conductor in the aperture.

DETAILED DESCRIPTION

Figure 1:
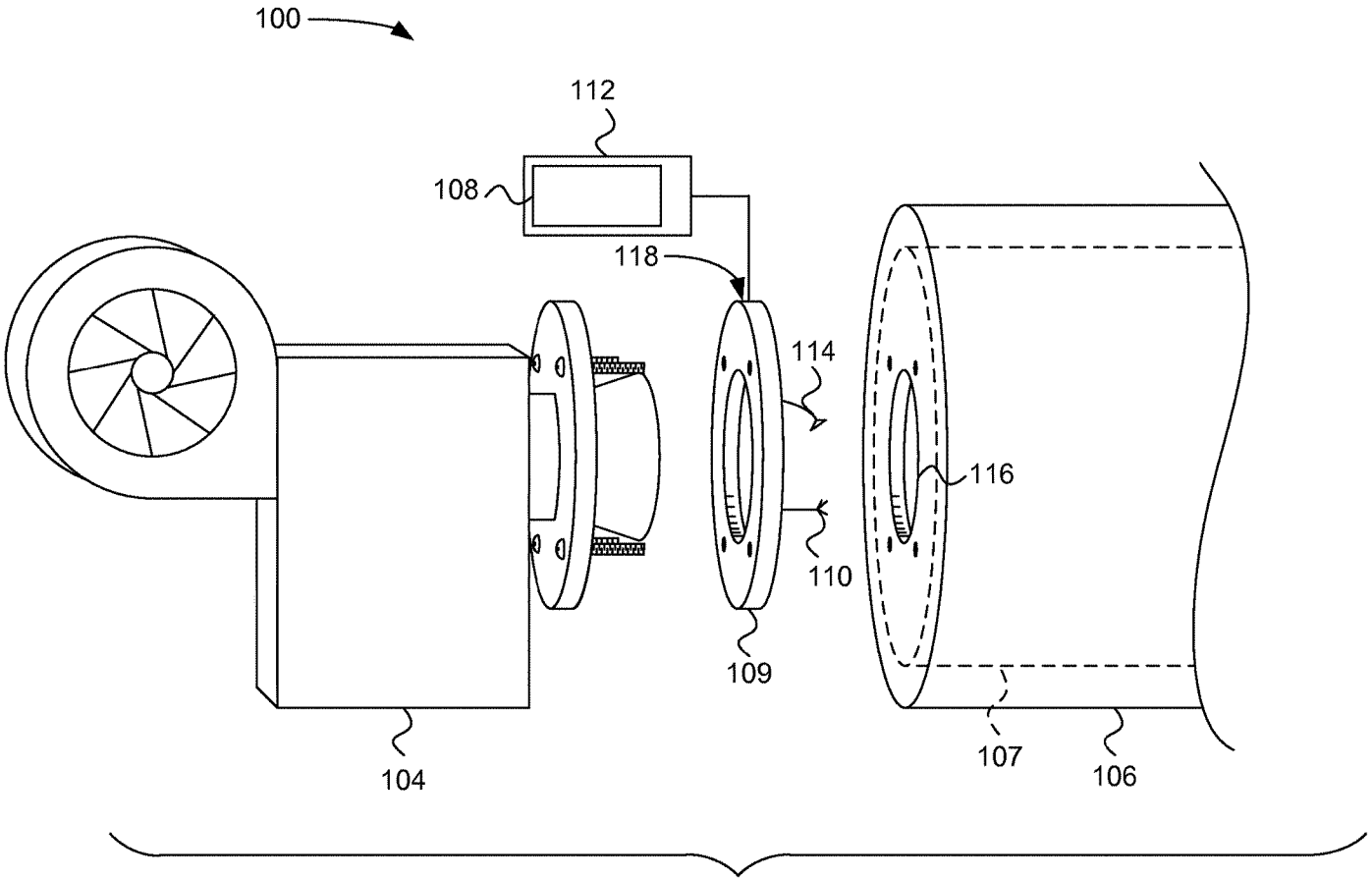
FIG. 1 is an exploded diagram of a combustion system including an adaptor, according to an embodiment.

In the following detailed description, reference is made to the accompanying drawings, which form a part hereof. In the drawings, similar symbols typically identify similar components, unless context dictates otherwise. Other embodiments may be used and/or other changes may be made without departing from the spirit or scope of the disclosure.

FIG. 1 is an exploded diagram of a combustion system 100, according to an embodiment. An embodiment relates to a combination of a burner assembly 104 and a combustion chamber wall 106. The combustion chamber 107 may be, for example, the interior or furnace of a package boiler, a custom boiler, a process heating furnace, or other known heating device. In an embodiment, the combustion chamber wall 106 can include a steel shell or a steel shell with a lining of refractory high-temperature insulation.

The inventors are primarily concerned with combinations in which the burner assembly 104 is attachable and detachable from the combustion chamber wall 106. Conventionally, the burner assembly 104 and the combustion chamber wall 106 are removably fastened directly to each other by bolts.

Control of combustion by high-voltage electricity inside the combustion chamber 107 has been found by the applicants to have strong and beneficial effects on flame shape and flame chemistry. The use of electricity for flame control is described in co-pending U.S. application Ser. No. 14/029,804, entitled "CLOSE-COUPLED STEP-UP VOLTAGE CONVERTER AND ELECTRODE FOR A COMBUSTION SYSTEM", filed Sep. 18, 2013; Ser. No. 14/144,431, entitled "WIRELESSLY POWERED ELECTRODYNAMIC COMBUSTION SYSTEM", filed Dec. 30, 2013; and Ser. No. 14/179,375, entitled "METHOD AND APPARATUS FOR DELIVERING A HIGH VOLTAGE TO A FLAME-COUPLED ELECTRODE", filed Feb. 12, 2014; the contents of which are each incorporated herein by reference.

FIG. 1 depicts the burner assembly 104, the combustion chamber wall 106, a combustion controller 108, and an adaptor 109 configured for insertion between the burner assembly 104 and the combustion chamber wall 106, so as to provide output of fuel and air by the burner assembly 104 and input of electrical energy through an opening 116 into the combustion chamber 107, according to an embodiment.

The combustion system 100 includes the combustion chamber wall 106 defining the combustion chamber 107. The burner assembly 104 is configured to operatively couple to an exterior of the combustion chamber wall 106 and to support a combustion reaction inside the combustion chamber 107. For example, when coupled directly together, the burner assembly 104 and combustion chamber wall 106 can form a conventional combustion system. One object of embodiments described herein is to allow retrofitting such a conventional combustion system to an upgraded combustion system wherein high voltage electrical energy is applied to one or more electrodes 110 proximate to a combustion reaction inside the combustion chamber 107.

In an embodiment, the adaptor 109 is configured to couple between the burner assembly 104 and the combustion chamber wall 106. The adaptor can include an adaptor body defining an aperture 118 configured to pass an electrical conductor therethrough. The electrical conductor can be configured to carry a high voltage electrical signal from outside the combustion chamber wall 106 to inside the combustion chamber 107 through the adaptor body aperture 118.

The aperture can be configured to receive an electrical bushing 214 configured to carry the electrical conductor.

Also shown in FIG. 1 are other parts of the combustion controller 108 configured to control, or which may optionally be integrated with, a power supply 112 configured to provide a high voltage to the flame-controlling electrode 110. Optionally, a sensor 114 may be operable to provide, to the combustion controller 108, information about combustion inside the combustion chamber 107 (shown by dashed lines in FIG. 1), whereby the combustion controller 108 may provide flame-control with feedback from the sensor 114. It will be understood that the adaptor 109 may have several functions, including mechanical attachment of the burner assembly 104 to the combustion chamber wall 106, sealing against leakage of air, fuel, or flame, passing electrical high voltage and/or current from outside to inside the combustion chamber wall 106 or back, mechanically supporting the electrodes 110 within the combustion chamber 107, etc.

In an embodiment, portions of the electrodynamic combustion system 100 may optionally include the power supply 112, which can be configured as a portion of a voltage controller 108. The voltage controller 108 may include analog circuitry, a processor, computer, and may adjust the voltage of the power supply 112 according to timing, flame feedback, predetermined criteria, etc. If a processor or computer is included, it will be operated as a programmed computer, and when not running may store the program in a non-transitory medium. In addition to the illustrated power supply (and/or current source) 112 disposed outside of the combustion chamber 107 or the combustion chamber wall 106, there may also be provided other sources of voltage or current, or circuit components, disposed inside the combustion chamber 107 or on its wall 106; for example, transformers, rectifiers, and the like may be disposed inside the adaptor 109 and/or inside the combustion chamber wall 106, or in the combustion chamber 107 or in a burner tile, and may act as functional parts of the electrodynamic combustion system 100. Such internal components might, for example, permit the electricity arriving at the adaptor 109 from the electrodynamic combustion system power supply 112 to be replaced or augmented by a source of relatively low-voltage electricity, which would increase safety; they might include a voltage converter that may include a transformer, a switching power supply, a charge pump, and/or a voltage multiplier, for example.

The electrodynamic combustion system power supply 112 may produce electricity selected to create electric fields and/or provide charge to influence the combustion reaction in the combustion chamber 107.

The adaptor 109 also includes an electrical aperture 118. This electrical aperture 118 may provide a path for electrical connection between elements outside the combustion chamber 107, such as the power supply 112, and elements inside the combustion chamber 107, such as the electrode 110. Optionally, one or more sensors, or other internal electrical components 114 may also be electrically connected to elements outside the combustion chamber 107. In this way a combustion reaction inside the combustion chamber 107 is controllable by the power supply 112 via an induced charge, voltage, current or electric field in the vicinity of the combustion reaction inside the combustion chamber wall 106. One or more apertures 118 may be provided for various flame- or combustion-control voltages and/or sensor signals.

According to an embodiment, the inventors contemplate a variant of the adaptor 109 wherein only low voltage signals are passed between outside the combustion chamber 107 and inside the combustion chamber 107.

Figure 2:
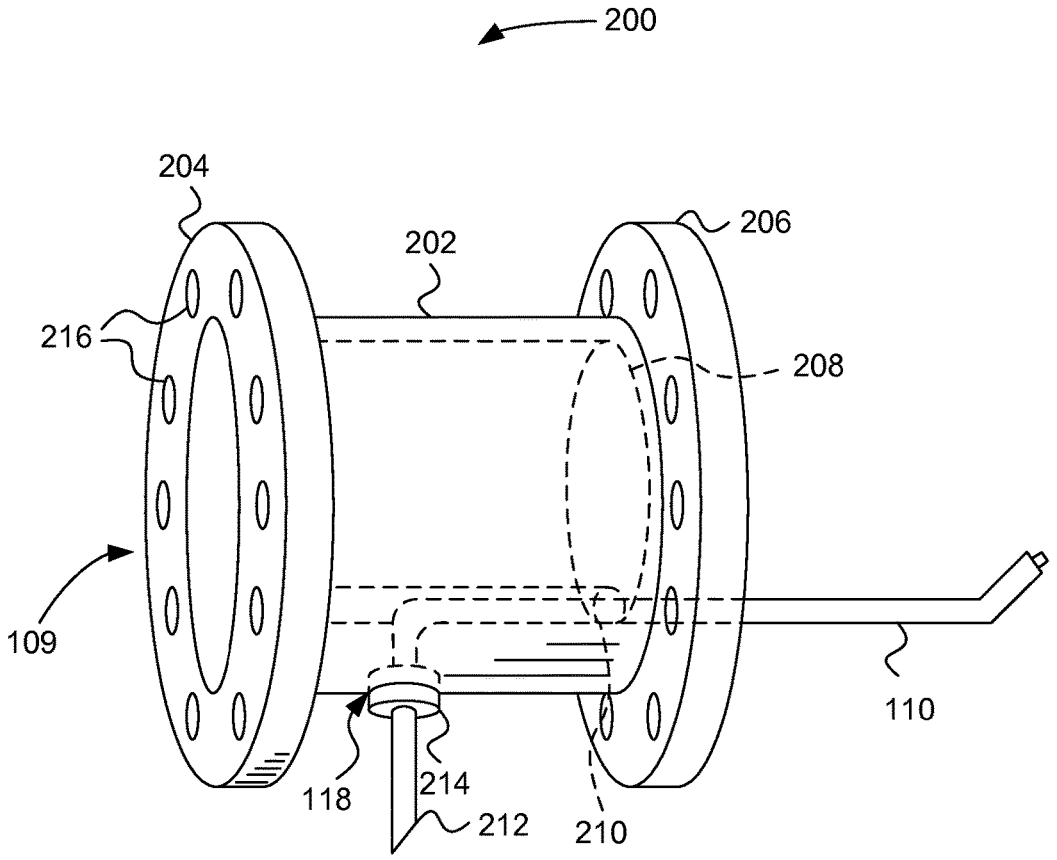
FIG. 2 is a perspective view of an adaptor for mounting between a burner assembly and a wall of a combustion chamber, according to an embodiment.

FIG. 2 shows an embodiment 200 of the adaptor 109, which may, in this case, include a short tube 202 that can be disposed between the burner assembly 104 (shown in FIG. 1) and the combustion chamber 107 (shown in FIG. 1). The adaptor 109 may also include a proximal flange 204 and a distal flange 206 configured to respectively bolt to the burner assembly 104 and the combustion chamber wall 106 (shown in FIG. 1).

The aperture or apertures 118 may be located outside of a primary air flow can 208 that is disposed inside the adaptor 109 (generally, this is a smaller tube inside the tube 202 illustrated in FIG. 2, and optionally parallel though not necessarily coaxial). The flow can 208 may be larger, the same, or smaller in diameter than an outer diameter of the burner assembly 104. According to an embodiment, the inventors contemplate an aperture that conveys an electrical signal (e.g., high voltage signal) through a wall of a tube 202 that also acts as an airflow passage. In some embodiments, the tube 202 may define a mixing chamber for a premix or partial premix section. In other embodiments, the tube 202 may define a secondary air flow passage that is separated from primary combustion air by the primary air flow can 208. In other embodiments, the burner may not use any secondary combustion air and the primary air flow can 208 may be omitted.

FIGS. 1-2 show that the electrode 110 may be attached to the adaptor 109. However, the electrode 110 may also be mounted to the inside of the combustion chamber 107 or elsewhere on the combustion chamber wall 106, in which case the electrode 110 may be electrically connected to a conductor passing into the combustion chamber 107 via the adaptor 109.

To be able to assemble the electrodes 110 first and then add the burner assembly 104, a person skilled in the art may need to add an open-ended slot 210 in the air flow can 208 that will allow the air flow can 208 to be inserted without mechanical interference with the electrode 110. In an embodiment, the inventors contemplate providing the adaptor 109 as a kit including a cutting or drilling template for specifying modification(s) to be made to the air flow can 208 or other component of the burner assembly 104. However, one purpose for the adaptor 109 is to allow a standard burner assembly 104 (e.g., fuel source, fuel nozzle, air source, air damper, blower, premixer, and/or controller, with associated parts) to be used. Hence, the inventors contemplate looping the electrodes 110 and/or leads from the aperture 118 around the distal end of the air flow can 208 when the air flow can 208 is in place (for systems that include air flow cans 208). In this way there is no change to the burner assembly 104 and no mechanical interference. Thus, the adaptor 109 includes cases of the electrode 110 passing through the slot 210 or fitting in the air flow can 208, and cases of the electrode 110 remaining outside the air flow can 208.

In this embodiment the feed-through or aperture 118 conducts electricity or signals through the tube 202 wall so as to electrically connect the power supply 112 (shown in FIG. 1) to the electrode or electrodes 110, which may project toward and/or into the combustion chamber 107. In an embodiment, this aperture 118 further includes a central conductor 212 inside a surrounding insulator 214. This surrounding insulator 214 might be a high-temperature insulator such as ceramic, air, or vacuum.

It is known in the art that the air flow can 208 may separate primary from secondary combustion air. Consequently, no matter where the electrode 110 is (inside or outside the can 208), it likely is in combustion air flow. If the primary air flow can 208 is provided or used, then the flame may include a primary flame that is supported by fuel and primary combustion air supplied inside the primarily air flow can 208, while the region in between the air flow can 208 and the inside of the tube 202 contains secondary combustion air but not substantial fuel. In this case it may be practical to pass an electrode through an open hole or opening in the side of the tube 202. That is, the insulator 214 surrounding the conductor 212 might be omitted and replaced with air, if the resulting opening were not to upset the air-flow balance of the combustion, and if the central conductor 212 were mechanically supported in such a way that it would not touch the edges of the hole in the tube 202.

The conductor 212 may in some instances be integral with the electrode 110.

In embodiments, the distal flange 206 of the adaptor 109 may be fastened to the combustion chamber wall 106 with threaded fasteners (i.e. bolts, studs and nuts, or screws) deployed in a substantially circular layout onto a steel plate forming the outer surface of the combustion chamber wall 106 (shown in FIG. 1). In such an embodiment, the proximal and distal flanges 204, 206 of the adaptor 109 may have the same layout of holes 216 in each flange. The flange holes 216 can be aligned with one another, so that the fasteners can proceed straight through both holes 216, or, they can be offset angularly around an axis of the short, flanged tube 202 so as to allow better access to bolt heads or nuts of the respective fasteners.

The proximal and distal flanges 204, 206 are respective examples of a proximal mount (adjacent the burner assembly) and a distal mount (adjacent the combustion chamber wall 106).

In an embodiment, the axial length of the flanged tube 202 of FIG. 2 may be minimized to minimize a change in distance of extension of the fuel nozzle and/or flame holder into the combustion chamber 107. It is expected that the burner assembly 104 can be moved away from the combustion chamber wall 106 and will still perform as intended. However, change from a nominal design (i.e., without the electrical feedthrough adaptor 109) may desirably be minimized to avoid any possible complications, which suggests minimizing the height of the illustrated adaptor collar (the axial length of the tube 202 plus thicknesses of the proximal and distal flanges 204, 206).

Figure 3A:
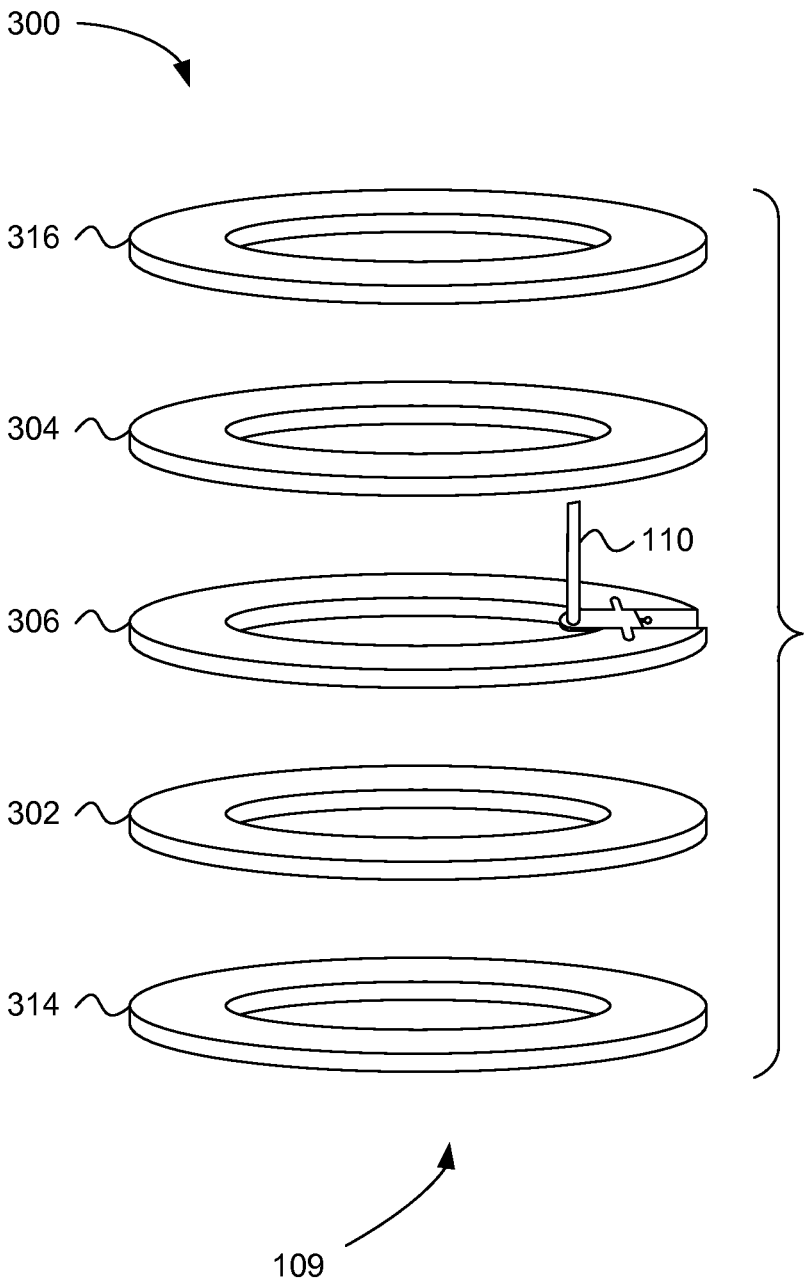
FIG. 3A is an exploded perspective view of an adaptor for mounting between a burner assembly and a wall of a combustion chamber, according to another embodiment.
Figure 3B:
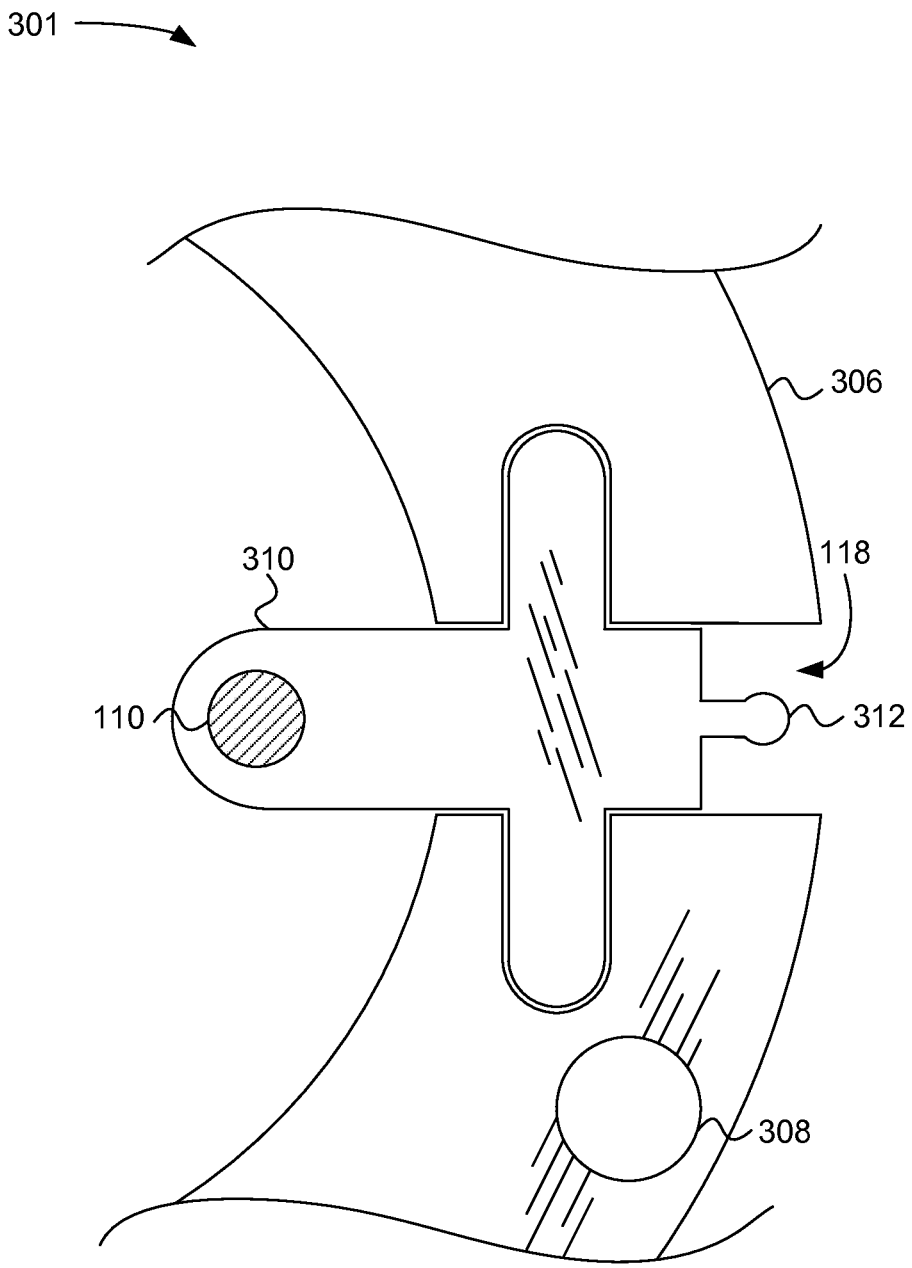
FIG. 3B is a detailed view of a portion of the adaptor of FIG. 3A, according to an embodiment.

FIGS. 3A and 3B show an embodiment 300, 301 of the adaptor 109 consisting essentially or primarily of flat plates or sheets of metal and insulation, which is deployed as would be a gasket between the burner assembly 104 (shown in FIG. 1) and the combustion chamber wall 106 (shown in FIG. 1). This gasket-like construction may minimize the thickness of the adaptor 109. The adaptor 109 may include two insulating plates 302 and 304, and between these insulating plates 302 and 304 can be a compound plate 306 that is made of contiguous sections of insulation and conductive metal, pieced together akin to a jigsaw puzzle.

The insulation sections or portions of the compound plate 306 surround bolt holes 308 (for simplicity of illustration, only one is shown, in FIG. 3B, but they are analogous to the flange holes 216 of FIG. 2) to provide insulation from grounded bolts, and may substantially surround metal portions 310 that are used to transfer electricity or signals through the adaptor 109, and which embody the aperture 118 of FIG. 1. The metal portion 310 of plate 306 may be fixed to the electrode 110 (shown in cross section in FIG. 3B) and support it for projection into the combustion chamber 107 (shown in FIG. 1) beyond the combustion chamber wall 106. At the opposite end the metal portion 310 may include a fitting 312 onto which an insulated high-voltage wire can be snapped, as an example; other types of electrical connection can be used, for example, solder.

When bolts through the bolt holes 308 are tightened, the metal portion 310 of the compound plate 306 can be held tightly by compressive force and thereby hold the electrode 110 immobile. In an embodiment, the sandwich of plates 302-304 may be encased in additional metal plates 314 and 316, for mechanical strength. These may be omitted if the burner assembly 104 and the combustion chamber wall 106 are rigid enough and a compression-force annulus or area between the burner assembly 104 and the combustion chamber wall 106 is wide enough to provide sufficient support for the metal portion 310 and the electrode 110 fixed to it.

In an embodiment, the applicants contemplate applying high voltages of up to or beyond about 20 kV. In another embodiment, the applicants contemplate applying high voltages up to or beyond 40 kV. This implies that the insulating plates 302, 304 might need to be only a few millimeters thick, and that the entire sandwich might be as little as a fraction of an inch in thickness, thereby shifting the position of the burner assembly 104 relative to the combustion chamber wall 106 by only that amount, as compared to its position without the adaptor 109.

While only one metal portion 310 is illustrated in FIG. 3A and 3B, more than one can be used. If several are provided to share a common voltage, then these may be connected inside the bore of the adaptor 109 or by conductive segments or wires in the compound plate 306.

Figure 4:
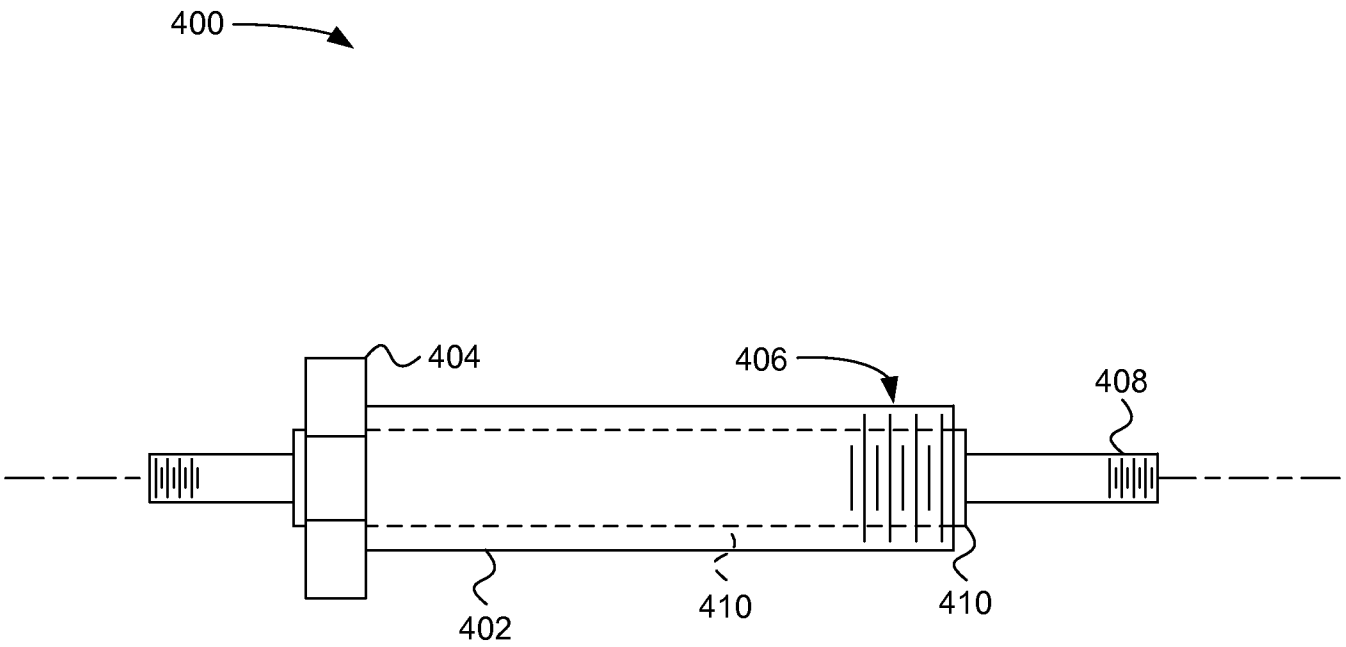
FIG. 4 is a view of a coupling, according to an embodiment.

FIG. 4 illustrates a third embodiment of the adaptor 109 of FIGS. 1-3A that may employ, as the aperture 118, hollow bolts 400 in place of conventional bolts used to join the burner assembly 104 and the combustion chamber wall 106. These hollow bolts 400 constitute the adaptor 109 and also the electrical aperture 118. Like conventional bolts that might be used to attach a burner assembly to a combustion chamber, the hollow bolts 400 include a cylindrical portion 402 with a head 404 and threads 406. In this third embodiment, each bolt 400 used to secure the burner assembly 104 to the combustion chamber wall 106 has a central bore which contains a central (preferably axial) conductive wire or rod 408, surrounded by an electrically insulating tube 410. To insulate 20-40 or more kV, insulation such as polyethylene or ceramic may need to be only thicker than about 2 mm, so this embodiment can be incorporated into bolts 400 of ordinary size, such as half-inch-diameter bolts. The central wire or rod 408 can connect on the outside to the power supply 112 of the electrodynamic combustion system 104, and on the inside can be electrically coupled to the electrode 110, by conventional means such as the illustrated male threads 406. This embodiment can be combined with the "tile anchors" often used to hold a burner tile. The illustrated bolt 400 is not only exemplary of other conventional threaded fasteners that might be replaced, such as studs and screws, but also exemplifies fasteners in general such as non-threaded fasteners. The inventors contemplate replacing conventional hardware of any sort, whether used to fasten a burner assembly, a burner assembly tile, or another part of combustion device.

This embodiment has several advantages. First, the burner assembly offset as compared to that without is negligible. Second, the electrode 110 can be fastened directly to the inner threaded end of the central rod 408, or, to the threads 406 at the inner ends of the bolts 400 by insulating supports that thread onto the bolt threads 406, either of which will provide good mechanical support if the electrodes 110 extend into the combustion chamber 107, and, the hollow bolts 400 may allow for rotation of the electrodes 110 about the bolt axes (an axis is shown by a dot-dash line in FIG. 4), by turning the bolts 400 or central rods 408. Third, individual bolts 400 can be replaced by studs extending from one or more inner brackets, with the studs extending through the combustion chamber wall 106 and being capped with nuts to hold the burner assembly 104. If two or more studs were attached to a bracket, it will resist rotation when the studs are inserted through bolt holes 308 in an object such as the distal flange 206, burner assembly 104, or combustion chamber wall 106. These brackets, which hold the studs irrotational against nut-tightening torque, can double as supports for the electrodes 110 or for sensors 114, the signals from which can also be transferred through the combustion chamber wall 106 by the hollow bolts 400. As the hollow bolts 400 may have cylindrical symmetry, they may be employed as coaxial cables to transmit high-frequency signals from sensors inside the combustion chamber 107.

A fourth embodiment can include a metallic flanged tube through which magnetic fields can propagate. If needed, the tube can include a window. The window can be covered with a sheet of material relatively impervious to air and/or flame but able to pass magnetic fields, or may be open. Such a window will allow the construction of a transformer, with a low-voltage coil on the outside of the adaptor 109 for safety, but with a high-voltage coil on the inside for flame control by the electrodes 110. In this embodiment, the tube itself or the window constitutes an electrical aperture (because the magnetic fields, even if not themselves "electrical", act to pass electricity).

A fifth embodiment may use the tube 202, between the proximal and distal flanges 204, 206, as the core of a transformer. An inner high-voltage coil can be grounded at one end and, at the other end, be connected to or include the aperture 118. An outer, low-voltage coil can drive the inner coil. This embodiment may include a grounded metal housing for safety.

Figure 5:
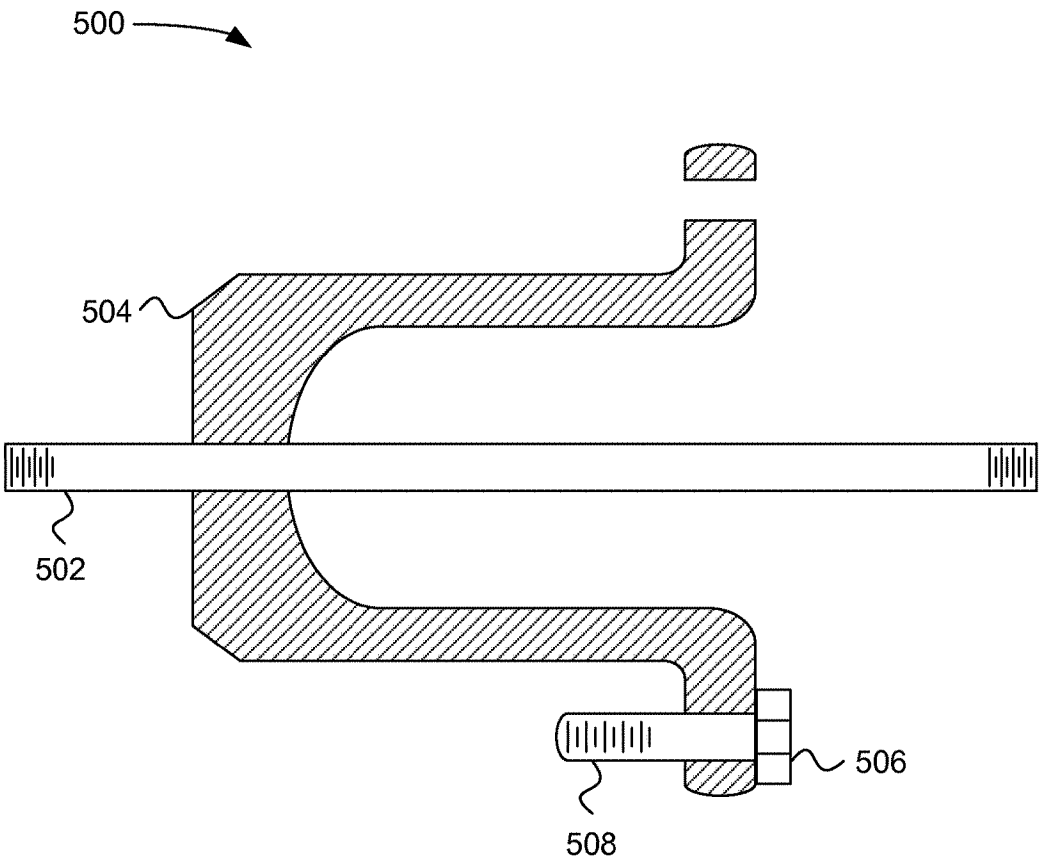
FIG. 5 is a partial cross-section view of a coupling, according to an embodiment.

FIG. 5 illustrates a sixth embodiment 500 of the electrical aperture 118 (shown in FIGS. 1 and 2), which also uses air as an insulator. A conductive rod 502 passes through the end of a standoff insulator 504 (shown in cross section), which is made of ceramic or other high-temperature electrically insulating material, and which holds the conductive rod 502 in position. Threaded fasteners may take the form of bolts with heads 506 and threads 508, or, other fastening can be used to hold the standoff 118 in position. This embodiment uses air as an insulator, to prolong the electrical discharge path through the solid standoff insulator 504.

In all the embodiments discussed above, the electrical aperture 118 acts to pass through electricity needed for electrodynamic combustion control. Thus the type and thickness of insulation, and the arrangement of the parts, must be such that there is not substantial leakage of electricity to the burner assembly 104 (shown in FIG. 1) or the combustion chamber wall 106 (shown in FIG. 1) (normally, to ground potential). "Substantial" leaking of electricity is defined as the amount of leakage, sparking, or discharge that interferes with electrodynamic combustion control, whether by lowering electrode voltage or current or by interfering with the control mechanisms employed, to an extent that the applicants' object of improving and controlling flames and combustion processes inside the combustion chamber 107 is compromised.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A combustion system, comprising:

a combustion chamber wall defining a combustion chamber;

a burner assembly configured to operatively couple to an exterior of the combustion chamber wall and to support a combustion reaction inside the combustion chamber;

an adaptor accessory mounted between the burner assembly and the combustion chamber wall; and at least one fastener configured to fasten the adaptor accessory to the burner assembly and to the combustion chamber wall;

wherein the adaptor accessory includes an adaptor body defining an aperture configured to pass an electrical conductor therethrough; and wherein the electrical conductor is configured to carry a voltage electrical signal from outside the combustion chamber wall to inside the combustion chamber through the adaptor body aperture;

whereby the adaptor accessory retrofits the combustion system.

2. The combustion system of claim 1, wherein the aperture is configured to receive an electrical bushing; and wherein the electrical bushing is configured to carry the electrical conductor.

3. The combustion system of claim 2, wherein the electrical bushing further comprises a ceramic electrical insulator.

4. The combustion system of claim 1, further comprising:

a power supply disposed outside the combustion chamber and operatively coupled to the electrical conductor; and at least one electrode disposed inside the combustion chamber and operatively coupled to the power supply via the electrical conductor.

5. The combustion system of claim 4, wherein the power supply and the at least one electrode are configured to cooperate to apply electrical energy in proximity to the combustion reaction.

6. The combustion system of claim 4, wherein the power supply is configured to output a high voltage electrical signal through the electrical conductor to the at least one electrode.

7. The combustion system of claim 6, wherein the power supply is configured to output a high voltage electrical signal greater than about 20 kilovolts through the electrical conductor to the at least one electrode.

8. The combustion system of claim 4, wherein the electrode is configured to apply an electrical field near the combustion reaction.

9. The combustion system of claim 4, wherein the electrode is configured to output charged particles to the combustion reaction.

10. The combustion system of claim 4, wherein the electrode is configured to not form an electrical spark.

11. The combustion system of claim 1, wherein the burner assembly comprises a burner assembly flange configured to couple to the combustion chamber wall; and wherein the adaptor accessory comprises:

a proximal coupling surface configured to couple to the burner assembly flange;

an adaptor wall projecting away from the proximal coupling surface; and a distal coupling surface coupled to a distal end of the adaptor wall and configured to couple to the combustion chamber wall.

12. The combustion system of claim 11, wherein the adaptor accessory includes a proximal adaptor flange on which the proximal coupling surface is formed;

wherein the adaptor accessory includes a distal adaptor flange on which the distal coupling surface is formed; and wherein the adaptor wall extends from the proximal adaptor flange to the distal adaptor flange.

13. The combustion system of claim 11, wherein the aperture is formed in the adaptor wall.

14. The combustion system of claim 1, wherein the aperture defined by the adaptor body has a shape configured to receive an electrical bushing.

15. The combustion system of claim 14, wherein the aperture defined by the adaptor body is threaded.

* * * * *